United States Patent [19]

Bremer

[11] 4,381,694

[45] May 3, 1983

[54] RECOIL BLOCK OR BRAKE FOR A LINEAR BREECH MECHANISM IN AN AUTOMATIC FIRE ARM

[75] Inventor: Clemens Bremer, Duesseldorf, Fed. Rep. of Germany

[73] Assignee: Rheinmetall GmbH, Duesseldorf, Fed. Rep. of Germany

[21] Appl. No.: 242,670

[22] Filed: Mar. 11, 1981

[30] Foreign Application Priority Data

Mar. 11, 1980 [DE] Fed. Rep. of Germany ..... 3009225

[51] Int. Cl.[3] ..... F41D 11/06

[52] U.S. Cl. ..... 89/190; 89/198

[58] Field of Search ..... 89/168, 176, 180, 182, 89/183, 190, 198

[56] References Cited

U.S. PATENT DOCUMENTS

| | | | |
|---|---|---|---|
| 2,890,626 | 6/1959 | Amsler | 89/180 |
| 3,890,881 | 6/1975 | Hurlemann et al. | 89/176 |
| 3,960,053 | 6/1976 | Conley | 89/190 |

*Primary Examiner*—Stephen C. Bentley

[57] ABSTRACT

A recoil brake or block mechanism for an automatic fire arm having a linearly reciprocating breech block. This mechanism includes a slide which is reciprocally mounted on the breech block. A two-armed lever is pivotally mounted in the housing of the fire arm and is adapted to coact with the slide so as to absorb a portion of the recoil energy. The slide has front and rear contacting surfaces and the two-armed lever has a pair of arms, each of which has a control surface which is adapted to respectively coact with one of said contacting surfaces. The center of gravity of the two-armed lever is located in the longer arm of the two-armed lever at a distance from its pivot support.

1 Claim, 2 Drawing Figures

RECOIL BLOCK OR BRAKE FOR A LINEAR BREECH MECHANISM IN AN AUTOMATIC FIRE ARM

BACKGROUND OF THE INVENTION

The subject matter of this invention is related to the disclosure of German published patent Application No. 1,119,726 and serves to prevent a premature unblocking, for example, during an ignition delay. The arrangement includes a spring-loaded recoil arresting lever in a breech body for purposes of coacting with a blocking head. There is also, axially slidably disposed in the breech body a blocking slider and a blocking-weight; a coil spring is arranged between the latter two. This prior art arrangement requires a large amount of coaction of predetermined parts, which must be coordinated in accordance with their mass and the frictional forces which occur between non-locking, non-irreversible stop surfaces in accordance with the forces exerted by the corresponding spring and in accordance with the corresponding intertia moments of the various parts. The large number of individual parts has been found to be disadvantageous, because they constitute a complex constructional assembly and, in view of the high velocity and acceleration, to which the assembly is exposed, constitutes not only a very large assembled mass, which is a drawback, but also such complex construction produces significant malfunctionings.

SUMMARY OF THE INVENTION

It is the object of this invention to provide a recoil blocking arrangement of the aforedescribed type wherein the drawbacks mentioned hereinabove are avoided and which is of simple construction, reliable and is inexpensively manufactured.

According to the present invention there is provided an automatic fire arm which has a firing-pin-carrying slide. This slide is adapted to lock the breech when in a forward limit position thereof, wherein a two-armed lever is provided rotatable about an axis relative to the fire arm alternatively to position abutment surfaces on opposite sides of said axis in the path of abutment surfaces of said slide, the arrangement being such that immediately before the slide reaches said forward limit position thereof a first of said abutment surfaces of the slide will contact a first of said abutment surfaces of the two-armed lever to deflect the same so that a second of said abutment surfaces of the two-armed lever is positioned to intercept a second of said abutment surfaces of the slide when the latter recoils from said foward limit position thereof.

Each of said abutment surfaces is preferably inclined with respect to the plane of reciprocative movement of the slide.

Said first of said abutment surfaces of the two-armed lever is preferably the rear surface of an upward projection at the free end of a shorter leading arm of the lever and said second of said abutment surfaces of the lever is preferably the leading edge of an upwardly-bent free end portion of a longer, rearwardly-extending arm of the lever, the center of gravity of the lever being spaced from said rotational axis thereof along said longer arm so that in a normal attitude of the fire arm the lever is biased by gravity to a position wherein said first abutment surface of the lever is not in the path of the slide.

The rear edge of said free end portion of the longer arm of the lever preferably constitutes a third abutment surface of the lever inclined with respect to the plane of reciprocative movement of the slide, the arrangement being such that if as the slide moves forward from a fully retracted position thereof said third abutment surface of the lever is in its path the latter will be deflected by said first abutment surface of the slide so as to position said first abutment surface of the lever in the path of the slide.

The rotational movement of the lever about its axis is preferably limited by the location of a forward projection of the lever within a cavity in the fire arm.

The slide is preferably mounted on a carrier therefore for limited reciprocative movement relative thereto and for reciprocative movement therewith relative to a fixed part of the fire arm in which the lever is rotatably mounted, the said abutment surfaces of the slide being the opposite end surfaces of an axially elongated guide projecting through and below the carrier below the surface of said fixed part on which the carrier is movable and above which opposite ends of the lever are alternatively raisable.

BRIEF DESCRIPTION OF THE DRAWINGS

With these and other objects, which will become apparent in the following detailed description, the present invention, which is shown by way of example only, will be clearly understood in connection with the accompanying drawings, in which.

DETAILED DESCRIPTION

In the accompanying drawing all but the relevant components of the firearm have been omitted for sake of clarity, but it is to be understood that except for the mechanism for retarding the recoil firing-pin-slide it generally belongs to the state of the art as examplified by disclosure of German Pat. No. 111 97 26.

Figure 1:
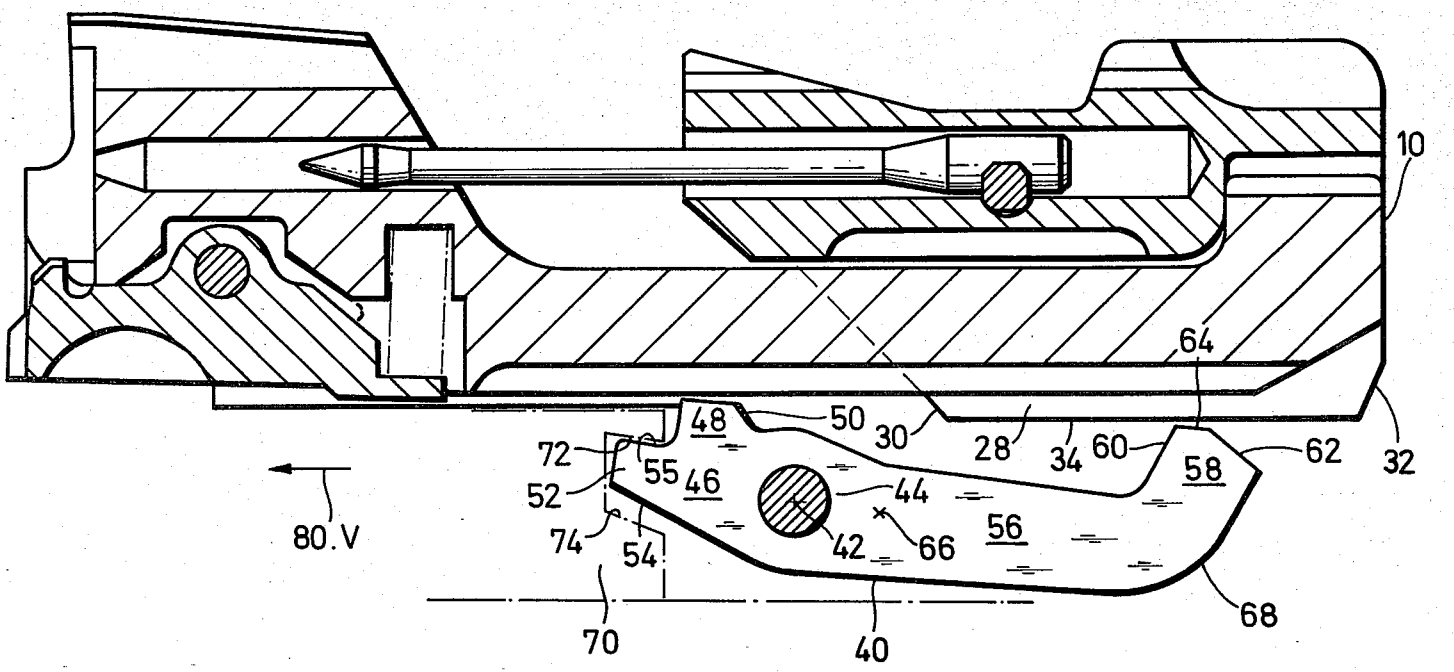
FIG. 1 is a sectional elevational schematic view of the recoil blocking mechanism of a straight-line breech block arrangement, wherein the arrangement is in a retracted non-locked condition.
Figure 2:
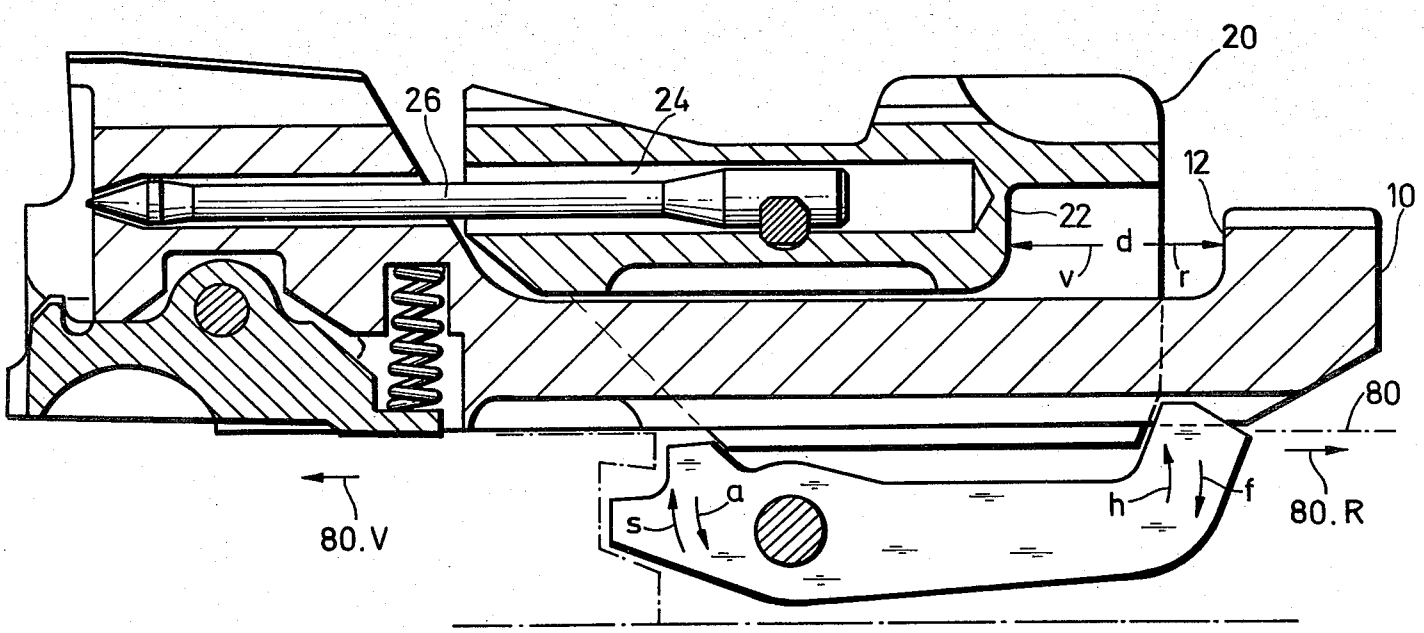
FIG. 2 illustrates the arrangement of FIG. 1 in schematic, sectional elevation, wherein the breech block mechanism is in a blocked or locked condition.

A breech block 10 of a straight-line slidable breech block mechanism of an automatic fire arm is arranged so that its forward path 80 in the direction of the arrow 80.V and its recoil path in the direction of the arrow 80.R are illustrated in FIGS. 1 and 2. The breech block 10 has an axially slidable blocking slide 20 mounted thereon which is provided with a bore 24 for accommodating a striker bolt or firing pin 26 therein. An entraining or abutment surface 12 on the breech block 10 coacts with the rear contacting abutment surface 22 of the blocking slide 20; between those two surfaces a maximum distance d is provided for producing the blocking illustrated in FIG. 2. On its underside the blocking slide 20 has a strip-shaped projection 28 having a frontal control abutment surface 30 and a rear control abutment surface 32. Both control surfaces 30, 32 are inclined at predetermined angles with respect to the path of movement 80. At the housing 70 the lever 40 is freely pivotally mounted about a support shaft 42 in a region 44. A first lever arm 46 has a first nose 48 provided with a control abutment surface 50. A second nose 52 of the lever arm 46 is defined from below by means of an exterior surface 54 of the lever arm 46 and from above by means of contacting abutment surface 55. A second lever arm 56 has a free end 58 which is inclined with respect to the path of movement 80; this free end 56 has a forwardly inclined abutment surface 60 and a rearwardly inclined abutment surface 62 and a connecting surface 64 disposed between the inclined surfaces 60 and 62 and an under-exterior surface 68. The center of gravity 66 of the lever 40 is disposed outside of the pivot support region 44 on the lever arm 56. In the housing 70 there is provided an upper limit surface 72 adapted to coact with the contacting surface 55 and a lower limit surface 74 adapted to coact with the exterior surface 54. In view of its free pivotal mounting and also in view of the location of its center of gravity, the two-armed lever 40 is positioned so that the first lever arm 46 projects with its nose 48 into the path of movement 80. It bears thereby with its contacting surface 55 against the upper limit surface 72.

The functioning of the recoil blocking mechanism of the invention is as follows: In the firing path the breech block 10 moves in the direction of the arrow 80.V until it reaches the position illustrated in FIG. 1 in which it is arrested. Due to its moment of inertia, the blocking slide 20 continues to move forwardly axially relative to the breech block 10 in the direction of the arrow v and arrives in a forward region of its path of movement 80 in which it is rigidly held by the non-illustrated blocking element (blocking region, wherefrom the blocking condition results). Immediately prior to reaching its most forward end position, the blocking slide 20 contacts, with its forward control surface 30, which is disposed on the underside projecting strip 28, the control surface 50 of the nose 48 of the two-armed lever 40 which lies in the path of movement 80 (FIG. 2). Thereby the blocking slide 20 transmits, in impulse-like fashion, a portion of its kinetic energy to the lever 40. Therefore, immediately before the slide 20 reaches its final, breech-locked position the leading abutment surface 30 of the projection 28 strikes the abutment surface 50 of the lever 40. This has the advantage of decelerating the slide 20 immediately before it reaches the breech-locking position, thus reducing the danger of premature rebound in the direction 80R, while at the same time positioning the surface 60 of the lever 40 in the path of the abutment surface 32 when the slide 20 recoils in the direction 80R through rotation of the lever 40 about the shaft 44. During the subsequent recoil movement of the slide 20 in the direction 80R energy is again exchanged between the slide 20 and the lever 40 resulting in a retardation of the initial movement of the slide 20 which is sufficient to prevent it from leaving its forward, breech-locked position until the ammunition in the breech has been detonated, even if detonation is delayed. This obviates the well-known dangers of delayed detonation occurring while the breech is being unlocked. The inclination of the abutment surfaces 32 and 60 ensures that the slide 20 is not arrested but merely retarded by the lever 40. The free end 58 of the arm 56 of the lever is deflected in the direction of the arrow f below the plane 80, causing the projection 48 on the arm 46 to move in the direction of the arrow s above the plane 80.

The mechanism of the invention is advantageous in its simplicity and reliability. In the event that the weapon is in an unusual attitude such that gravity does not return the lever 40 to the position shown in FIG. 1 abutment of the surface 30 with the surface 62 as the slide 20 moves in the direction 80.V will cause deflection of the lever 40 to the position shown in FIG. 1 where the projection 48 is positioned above the plane 80 in the path of the surface 30 of the slide, so that as the latter reaches the position in which the breech is locked the arm 46 of the lever is deflected in the direction of the arrow a so that the arm 58 is deflected in the direction of the arrow h, positioning the abutment surface 60 above the plane 80 to intercept the abutment surface 32 when the slide 20 recoils.

Although the invention is illustrated and described with reference to one preferred embodiment thereof, it is to be expressly understood that it is in no way limited to the disclosure of such a preferred embodiment, but is capable of numerous modifications within the scope of the appended claims.

I claim:

1. In an automatic firearm, a recoil brake mechanism for a breech block, which is linearly reciprocally mounted in the housing of the firearm said breech block having a slide reciprocally slidably mounted thereon which reciprocates parallelly with respect to said breech block along a predetermined path between a forward blocking position and a rear inoperative position, comprising (a) a two-armed lever pivotally mounted in said housing and adapted to coact with said slide;

(b) said two-armed lever having a first control surface which is selectively pivoted into the path of movement of said slide;

(c) said slide having front and rear contacting surfaces, disposed at predetermined distances from each other along said predetermined path;

(d) said front and rear contacting surfaces being inclined at predetermined angles with respect to said predetermined path of movement;

(e) said first control surface of said two-armed lever being disposed on a first arm of said two-armed lever;

(f) the center of gravity of said lever being disposed on a second arm of said two-armed lever at a distance from the pivotal axis of its pivotal mounting;

(g) said second arm having a second control surface which is inclined with respect to said predetermined path is selectively pivoted into said path, said center of gravity of said lever being disposed between said second control surface and said pivotal axis;

(h) said first control surface and front contacting surface being adapted to make contact with each other;

(i) said second control surface being disposed in said predetermined path of said slide when it is in its blocking position and said second control surface being adapted to coact with said rear contacting surface of said slide; and (j) said two-armed lever being pivotally mounted over a predetermined angular range.

* * * * *